United States Patent [19]

Yoshimaru et al.

[11] Patent Number: 4,963,930

[45] Date of Patent: Oct. 16, 1990

[54] DEVELOPING APPARATUS CAPABLE OF PREVENTING LEAKAGE OF A DEVELOPER

[75] Inventors: Akito Yoshimaru; Yoichiro Sugino, both of Kawasaki, Japan

[73] Assignee: Ricoh Company, Ltd., Tokyo, Japan

[21] Appl. No.: 391,047

[22] Filed: Aug. 9, 1989

[30] Foreign Application Priority Data

Aug. 29, 1988 [JP] Japan ..... 63-112156[U]
Jun. 2, 1989 [JP] Japan ..... 1-139175

[51] Int. Cl.[5] ..... G03G 21/00
[52] U.S. Cl. ..... 355/215; 355/304
[58] Field of Search ..... 355/215, 270, 301

[56] References Cited

U.S. PATENT DOCUMENTS 4,583,112 4/1986 Morano et al. ..... 355/215
4,800,411 1/1989 Tanaka et al. ..... 355/215

*Primary Examiner*—A. T. Grimley

*Assistant Examiner*—Nestor R. Ramirez

*Attorney, Agent, or Firm*—Oblon, Spivak, McClelland, Maier & Neustadt

[57] ABSTRACT

A developing apparatus using a dry developer in the form of a toner. The apparatus includes a housing having an opening which is located to face a photoconductive element. A vent is formed through the housing to release a pressure being developed in the housing, while a filter closes the vent to filter out a toner cloud. A smooth air guide plate which is more than 5 millimeters wide is provided in an edge portion of the opening downstream of a developing position with respect to an intended direction of a rotation of the photoconductive element. The air guide plate is spaced apart from the photoconductive element by a distance less than 2 millimeters and serves to increase the velocity of air flowing into the housing through the opening and, thereby, prevents toner particles from being released to the outside of the apparatus.

4 Claims, 4 Drawing Sheets

DEVELOPING APPARATUS CAPABLE OF PREVENTING LEAKAGE OF A DEVELOPER

BACKGROUND OF THE INVENTION

The present invention relates to a developing apparatus for use in image recording equipment which is implemented with an electrostatographic process and, more particularly, to a developing apparatus capable of preventing a dry developer in the form of a toner from leaking from a housing of the apparatus to the interior of the equipment.

A developing apparatus installed in an electrophotographic copier, facsimile machine, laser printer or similar image recording equipment which is implemented with an electrostatographic principle uses, in many cases, a dry two-component developer which is the mixture of a toner and a carrier. The developing apparatus includes a housing having an opening which is located to face the periphery of a photoconductive element or image carrier. A rotatable developing sleeve is disposed in the housing to face the photoconductive element through the opening. An agitating roller is also accommodated in the housing for agitating a toner being supplied and transporting it to the developing sleeve. Specifically, a dry two-component toner constituted by a toner and a carrier is deposited on the developing sleeve to form a magnet brush. The magnet brush is brought into contact with a latent image which is electrostatically formed on the photoconductive element by an electrostatographic process, whereby the toner is adhered to the latent image to turn it to a toner image. The developer remaining on the developing sleeve after the development is returned to the housing via a clearance existing between an edge portion of the housing and the developing sleeve while the the developing sleeve is rotated. A fresh toner is supplied to the returned developer which has lost a part of its toner due to the development. The fresh toner and the returned developer are agitated together by the agitating roller and fed again to the developing sleeve.

The housing is hermetically closed except for the opening through which the developing sleeve faces the photoconductive element, in order to prevent the leakage of the developer into the itnerior of the recording equipment. In this configuration, air flows into the housing while the developing sleeve is rotated. This, coupled with the rotation of the agitating roller, raises the pressure inside of the housing. A high pressure prevailing in the housing is apt to blow out a toner cloud through the clearance between the edge portion of the opening of the housing and the developing sleeve and further through the clearance between the edge of the opening and the photoconductive element, smearing the interior of the equipment.

A doctor blade is located upstream of a developing position where the developing sleeve and photoconductive element neighbor each other, and it is spaced apart from the developing sleeve by a small distance. A seal member is provided between an edge portion of the opening of the housing upstream of the developing position and the periphery of the photoconductive element. However, in a region downstream of the developing position, an adequate clearance has to be left between the developing sleeve and an edge portion of the opening of the housing in order to pass the developer or magnet brush deposited on the developing sleeve. An adequate clearance has to be provided between the downstream edge portion of the opening of the housing and the photoconductive element also, so that the toner image on the photoconductive element may pass without being disturbed. Hence, a toner cloud is blown out of the housing mainly through such two clearances downstream of the developing position.

Various approaches have heretofore been proposed to eliminate the blowoff of a toner cloud. For example, the housing may be provided with a vent and a filter which closes the vent, as disclosed in Japanese Laid-Open Patent Publication (Kokai) Nos. 56-46272, 60-3678 and 56-99604. The vent releases the internal pressure of the housing, while the filter prevents toner particles from flowing out through the vent. The implementation shown and described in the first-mentioned Laid-Open Patent Publication includes a vacuum pump or similar sucking device which is communicated to the vent by a piping. The implementation taught in the second-mentioned Laid-Open Patent Publication is such that air is forced from the clearance between the opening of the housing which faces the photoconductive element and the periphery of the photocoductive element to the interior of the housing by an air compressor and a piping. A drawback with these prior art schemes is that the vacuum pump, air compressor or similar extra device and its associated piping increases the cost of the apparatus. On the other hand, the third-mentioned Laid-Open Patent Publication causes the developing sleeve to rotate in the opposite direction to the photoconductive drum, so that a stream of air tending to such air through between the edge portion of the opening of the housing and the photoconductive element may be generated. However, when the rotating direction of the developing sleeve is not the same as that of the photoconductive element, there is a fear that a toner cloud is blown out of the housing.

SUMMARY OF THE INVENTION

It is therefore an object of the present invention to provide a developing apparatus capable of preventing a developer from leaking from a housing of the apparatus.

It is another object of the present invention to provide a simple and inexpensive developing apparatus capable of preventing a dry two-component toner from leaking from a housing of the apparatus.

It is another object of the present invention to provide a developing apparatus for image recording equipment which frees the interior of the equipment from smearing due to the scattering of a toner out of a housing of the apparatus.

It is another object of the present invention to provide a generally improved developing apparatus.

A developing apparatus for developing a latent image electrostatically formed on an image carrier by using a dry developer of the present invention comprises a housing having an opening which faces the image carrier, a developing sleeve disposed in the housing and in close proximity to the opening for transporting the dry developer being deposited thereon to a developing position between the image carrier and the opening, the dry developer developing the latent image at the developing position through the opening, a vent formed through the housing for releasing a pressure being developed in the housing, a filter closing the vent for preventing the dry developer from flowing out through the vent, and an air guide plate having a predetermined width and provided in an edge portion of the opening which is located downstream of the developing position with respect to an intended direction of movement of the image carrier at the opening of the housing, the air guide plate being spaced apart from the image carrier by a predetermined distance for sucking air through the opening.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
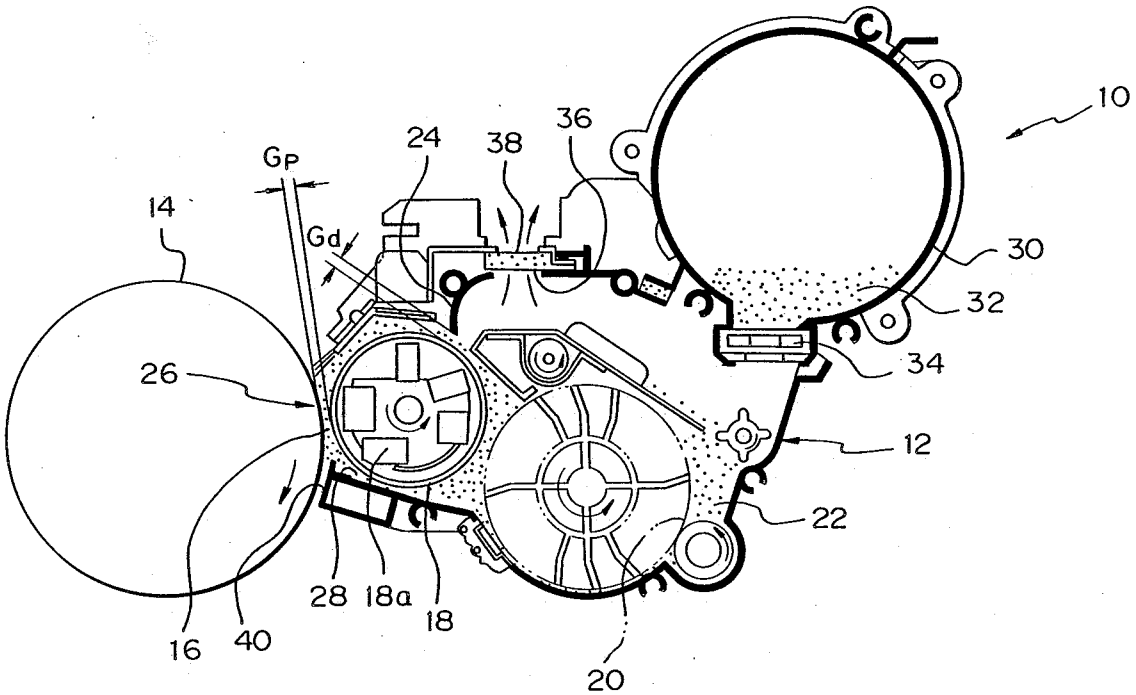
FIG. 1 is a section showing a developing apparatus embodying the present invention.

Referring to FIG. 1 of the drawings, a developing apparatus embodying the present invention is shown which uses a dry two-component developer. As shown, the developing apparatus, generally 10, has a housing 12 which is provided with an opening 16. The opening 16 is positioned to face the periphery of a photoconductive element 14 which is implemented as a drum. A developing sleeve 18 is disposed in the housing 12 and in close proximity to the drum 14. More specifically, the developing sleeve 18 faces the drum 14 through the opening 16 with a predetermined developing gap Gp being defined therebetween. The developing sleeve 18 is rotated in the same direction as the drum 14, i.e. in a forward direction. An agitating roller 20 is also disposed in the housing 12 in close proximity to the devoloping sleeve 18. A developer 22 is accommodated in the housing 12 and agitated by the agitating roller 20 to be electrostatically charged thereby. The charged developer 22 is transported by the agitating roller 20 to the developing sleeve 18. The developing sleeve 18 accommodates a plurality of magnets 18*a* therein. Therefore, the developer 22 is magnetically attracted onto the developing sleeve 18 and transported by the sleeve 18 toward the drum 14. A doctor blade 24 is located to face the developing sleeve 18 at a predetermined distance, or doctor gap Gd, from the latter. The doctor blade 24 regulates the thickness of the developer layer 22 on the developing sleeve 18 before the developer layer 22 reaches a developing position 26 where the opening 16 of the housing 12 faces the drum 14. After developing a latent image electrostatically formed on the drum 14, the developer 22 is returned to the housing 12 by way of a clearance 28 which is defined between the bottom of the sleeve 18 and the housing 12. The developer 22 so collected in the housing 12 has lost a part of its toner due to the development. A fresh toner 32 is supplied from a toner tank 30 to the developer 22 as a toner supply shutter 34 is controllably opened, the fresh toner 32 and the collected developer 22 being agitated together by the agitating roller 20. A vent 36 is formed through an upper portion of the housing 12 to release a pressure being developed in the housing 12, while a filter 38 having meshes small enough to block toner particles closes the vent 36. The rotation of the developing sleeve 18, coupled with the rotation of the agitating roller 20, causes air to flow into the housing 12 through the opening 16. Nevertheless, the pressure inside the housing 12 does not increase because the air is led out of the housing 12 through the vent 36. Despite the fact that the air flows out through the vent 36, the filter 38 prevents toner particles from being entrained by the stream of air to the interior of recording equipment in which the developing apparatus 10 is installed.

Specific numerical values associated with an actual developing apparatus having the above construction are as follows:

| | |
|---|---|
| (1) Volume of developer in housing | 1.0–1.4 kg |
| (2) Average carrier particle size of developer | app. 100 μm |
| (3) Average toner particle size of developer | app. 10 μm |
| (4) Toner content | 1.5–4 wt % |
| (5) Drum diameter | app. 80 mm |
| (6) Developing sleeve diameter | app. 40 mm |
| (7) Drum linear velocity | 180 mm/sec |
| (8) Developing sleeve linear velocity | (drum linear velocity) × app. 2.7 |
| (9) Doctor gap (Gd) | 0.6–0.9 mm |
| (10) Developing gap (Gp) | 0.8–1.1 mm |

Figure 2:
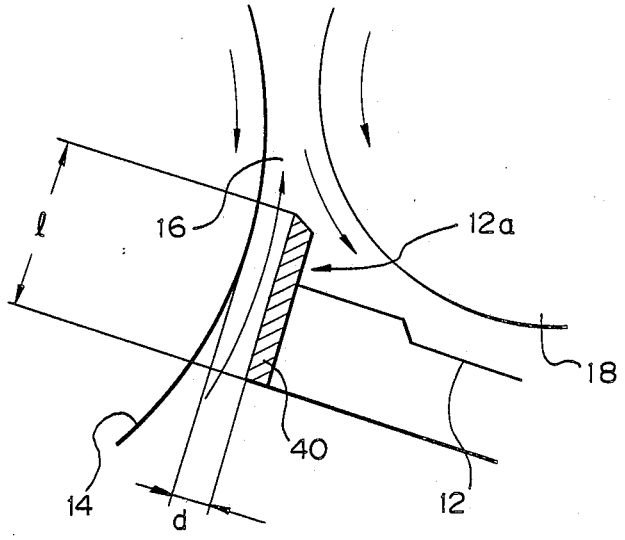
FIG. 2 is a fragmentary enlarged view of the apparatus of FIG. 1, showing the configuration of an air guide plate which is an essential structural element of the apparatus.

As shown in FIG. 2, the developing apparatus 10 further includes a smooth air guide plate 40. The air guide plate 40 has a width of l and is provided on an edge 12*a* of the housing 12 which defines the opening 16. The air guide plate 40 is spaced apart from the periphery of the drum 14 at a distance of d and extends over substantially the entire length of the opening 16.

Figure 3:
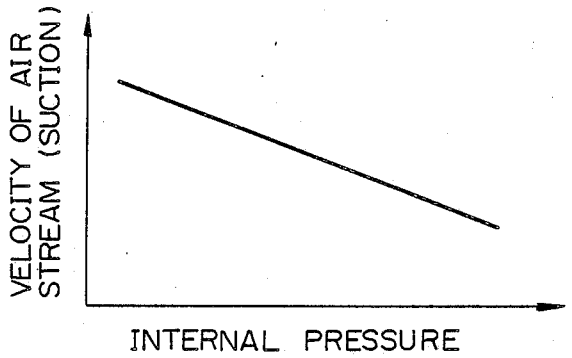
FIGS. 3 to 8 show curves useful for understanding the advantages of the present invention over the prior art.
Figure 4A:
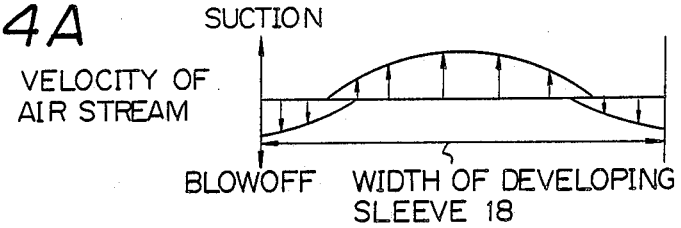
Figure 4B:
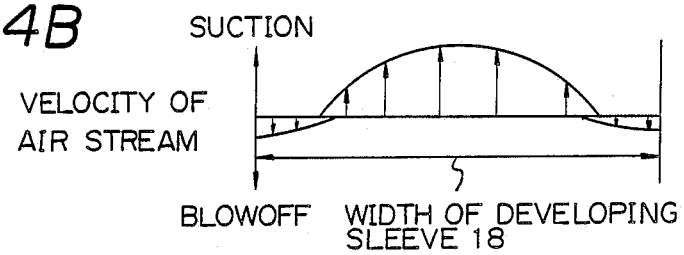

FIG. 3 is a graph showing qualitatively a relationship between the velocity of air stream as measured at the intermediate portion of the developing sleeve 18 and the pressure inside the housing 12. As shown, the lower the internal pressure of the housing 12, the higher the velocity of air stream becomes. FIG. 4A shows an air velocity distribution as measured in the widthwise direction of the opening 16 and in a part of the opening 16 adjacent to the bottom of the developing sleeve 18, when the opening 16 and air guide plate 40 are absent. On the other hand, FIG. 4B shows an air velocity distribution as measured in the same direction and in the same part of the opening 16 when the housing 12 is provided with the vent 36 and lacks the air guide plate 40. The distributions shown in FIGS. 4A and 4B were determined by experiments. In both of the two different conditions, the air velocity distribution is such that air is sucked in the intermediate portion of the sleeve 18 while it is blown out in opposite end portions, the suction and blowoff alternating with each other irregularly and unstably at the borders of the intermediate portion and end portions. By comparing FIGS. 4A and 4B, it will be seen that the vent 36 formed through the housing 12 serves to further increase the velocity of air being sucked in the intermediate portion of the sleeve 18 while reducing the velocity of air being blown out in the opposite end portions, thereby increasing the proportion of the suction to the blowoff as a whole. Further, FIG. 5 plots the amounts of scattered toner which are associated with the condition of FIG. 4 and were actually measured in the widthwise direction of the developing sleeve 18. As shown, the distribution of FIG. 5 closely corresponds to the velocity distribution of air being blown out.

Hereinafter will be discussed an air velocity distribution as measured in the widthwise direction of the opening 16 and in the vicinity of the bottom of the developing sleeve 18 when the housing 12 is provided with both the vent 36 and the air guide plate 40.

Figure 6:
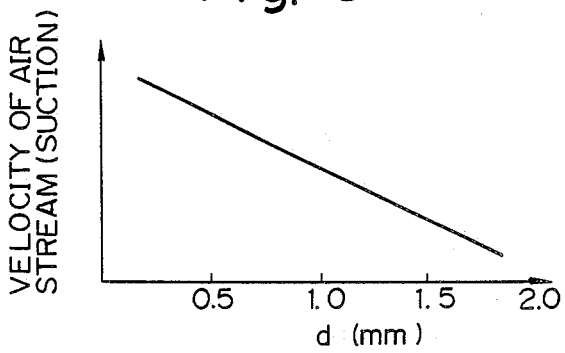
Figure 7:
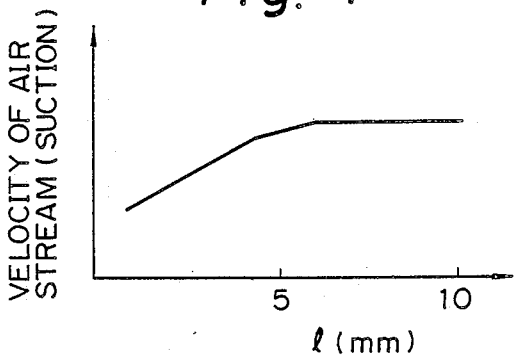

FIG. 6 is a graph showing a variation in the velocity of air being sucked with respect to the distance d (see FIG. 2) between the air guide plate 40 and the drum 14. As shown, the air velocity increases with the decrease in the distance d. This will be apparent from the fact that, if the velocity is constant, the cross-sectional area of a flow path and the velocity are inversely proportional to each other. As FIG. 6 indicates, distances d less than 2 mm are successful in achieving an acceptable degree of suction. FIG. 7 plots the velocity of air being sucked with respect to the width l of the air guide plate 40 as measured in the direction of air flow. As shown, when the width l is small, the air velocity decreases because turbulence occurs below the air guide plate 40 to disturb the smooth suction of air. It will be seen that widths l greater than 5 mm are sufficient for the air guide plate 40 to enhance smooth suction of air.

Figure 4C:
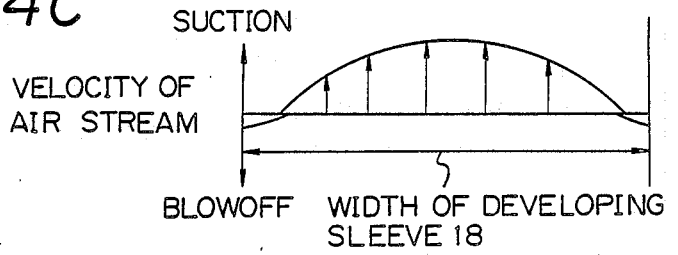
Figure 5:
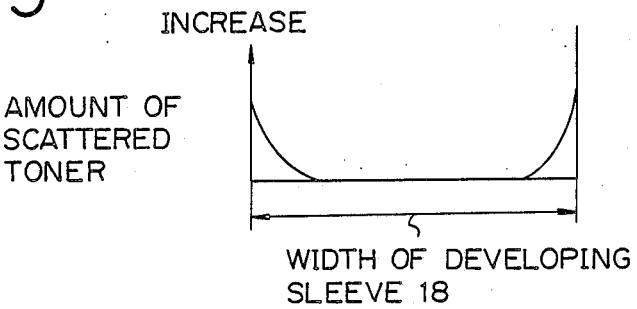
Figure 8:
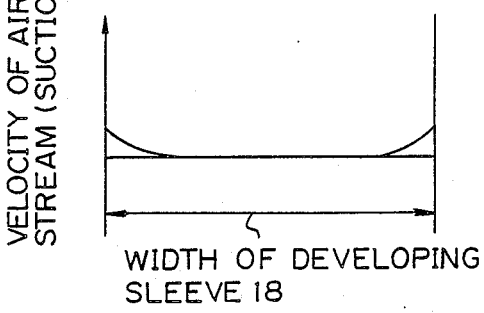

FIG. 4C shows an air velocity distribution as measured in the widthwise direction of the opening 16 and in the vicinity of the bottom of the developing sleeve 18 when the housing 12 is provided with the air guide plate 40 configured to satisfy the above condition and the vent 36. As shown, the border regions where the suction and blowoff alternate with each other irregularly are reduced, compared to the conditions associated with FIGS. 4A and 4B. Further, the suction range and air velocity at opposite ends are noticeably reduced. In such a condition, the proportion of the suction to the blowoff is significantly increased as a whole. As a result, as shown in FIG. 8, the amounts of scattered toner are distributed in association with the distribution of the velocity of air being blown out, i.e., the toner is scattered only in limited portions adjacent to the opposite ends of the developing sleeve 18 and by only a small amount.

In summary, in accordance with the present invention, a developing apparatus has a housing which is provided with a vent, a toner filter closing the vent, and a unique air guide plate. Such a housing eliminates the need for a vacuum pump, air compressor or similar mechanical device as well as a conduitwork associated therewith. Even when a developing sleeve is rotated in the same direction as a photoconductive element as is often the case with an image recording apparatus, the apparatus prevents a toner cloud from being blown out from the housing.

Various modifications will become possible for those skilled in the art after receiving the teachings of the present disclosure without departing from the scope thereof.

What is claimed is:

1. A developing apparatus for developing a latent image electrostatically formed on an image carrier by using a dry developer, comprising:

a housing having an opening which faces the image carrier;

a developing sleeve disposed in said housing and in close proximity to said opening for transporting the dry developer being deposited thereon to a developing position between the image carrier and said opening, said dry developer developing the latent image at said developing position through said opening;

a vent formed through said housing for releasing a pressure being developed in said housing;

a filter closing said vent for preventing the dry developer from flowing out through said vent; and an air guide plate having a predetermined width and provided in an edge portion of said opening which is located downstream of the developing position with respect to an intended direction of movement of the image carrier at said opening of said housing, said air guide plate being spaced apart from said image carrier by a predetermined distance for sucking air through said opening, wherein the predetermined width of said air guide plate is at least 5 millimeters.

2. An apparatus as claimed in claim 1, wherein said air guide plate extends over substantially an entire length of said opening of said housing.

3. An apparatus as claimed in claim 1, wherein the predetermined distance between said air guide plate and the image carrier is less than 2 millimeters.

4. A developing apparatus for developing a latent image electrostatically formed on an image carrier by using a dry developer, comprising:

a housing having an opening which faces the image carrier;

a developing sleeve disposed in said housing and in close proximity to said opening for transporting the dry developer being deposited thereon to a developing position;

a vent formed through said housing for releasing a pressure being developed in said housing;

a filter closing said vent for preventing the dry developer from flowing out through said vent; and an air guide plate having a predetermined width and provided in an edge portion of said opening, said air guide plate being spaced apart from said image carrier by a predetermined distance for sucking air through said opening, wherein the improvement comprises the predetermined width of said air guide plate being at least 5 millimeters.

* * * * *